US007286100B1

(12) United States Patent
McGinley, Jr.

(10) Patent No.: US 7,286,100 B1
(45) Date of Patent: Oct. 23, 2007

(54) ADJUSTABLE ANTENNA APPARATUS AND METHOD

(76) Inventor: Frank John McGinley, Jr., 113 N. C St., Pensacola, FL (US) 32501

( * ) Notice: Subject to any disclaimer, the term of this patent is extended or adjusted under 35 U.S.C. 154(b) by 229 days.

(21) Appl. No.: 11/212,251

(22) Filed: Aug. 27, 2005

(51) Int. Cl.
*H01Q 1/36* (2006.01)

(52) U.S. Cl. ..... 343/896; 343/874

(58) Field of Classification Search ..... 343/723, 343/874, 886, 896
See application file for complete search history.

(56) References Cited

U.S. PATENT DOCUMENTS 1,969,380 A * 8/1934 Meissner ..... 343/886
2,573,682 A * 11/1951 Barret ..... 324/335
3,487,412 A * 12/1969 Rogers ..... 343/707
4,670,760 A * 6/1987 Biby ..... 343/832
5,028,932 A * 7/1991 Boor ..... 343/723
7,109,946 B2 * 9/2006 Piole ..... 343/874

* cited by examiner

*Primary Examiner*—Tan Ho
(74) *Attorney, Agent, or Firm*—J. Nevin Shaffer, Jr.

(57) ABSTRACT

An adjustable antenna apparatus and method includes an antenna wire control device for controlling the release and retrieval of antenna wire. Antenna wire is attached to the antenna wire control device and an antenna wire tensioning device is attached to the antenna wire.

According to another aspect of the invention, the antenna wire control device includes a positive control device for preventing release and retrieval of the antenna wire.

18 Claims, 4 Drawing Sheets

ADJUSTABLE ANTENNA APPARATUS AND METHOD

FIELD OF INVENTION

This invention relates to an adjustable antenna apparatus and method. In one embodiment in particular, the invention relates to an adjustable antenna apparatus including an antenna wire control device for controlling the release and retrieval of antenna wire. Antenna wire is attached to the antenna wire control device and an antenna wire tensioning device is attached to the antenna wire.

BACKGROUND OF THE INVENTION

Antennas are an integral and critical part of any properly functioning radio transmission and receiving system. Many systems have built in small or even hidden antennas. Other system require bigger, visible antennas. In one area of the radio system art, multiple antennas of different sizes or lengths are required. For example only and not by way of limitation. High Frequency (HF) radio transmitters and receivers use a frequency range that is very wide. That is, the frequency ranges from approximately 1.5 megahertz (MHZ) to 30 MHZ. An ideal HF transmitter will operate efficiently over that entire frequency range and transmit at maximum power output so as to provide the best communication possible. In order for this to occur, the antenna must be resonate at the selected operating frequency. This requires that the antenna must be the correct length for the selected frequency. If the antenna is not the correct length for the frequency being used, the antenna will reflect some or all of the transmitted power (radio frequency (RF) energy) back to the transmitter and will cause a reduction of power output from the transmitter. This reduction of power output can cause poor communication transmissions and the reflected RF energy may also damage the transmitter.

Today's HF transmitters and transmitters/receivers (transceivers) are fully capable of transmitting, and receiving, over the entire frequency range. As just discussed, in order to do this effectively and efficiently, the user must constantly change the length of the antenna to match the selected frequency. This requires the stock piling of antennas from as short as fifteen and one-half feet to antennas as long as three hundred twelve feet and everything in between. The Applicant has calculated that in order to be able to operate efficiently and with an acceptable amount of reflected power on all HF frequencies from 1.5 MHZ to 30 MHZ a user needs anywhere from one hundred and fifty to two hundred separate antennas. Additionally, the setting up and taking down must be done whenever a new frequency must be used. This results in users having to go outside, in inclement weather, sometimes at night and at other inconvenient and inopportune times in order to lower the current antenna to the ground, adjust it to the correct length and raise it back up. While some HF antennas and associated antenna equipment, i.e. antenna tuners, claim to work on all frequencies, they are inefficient, very large and often very expensive and truly do not work at peak efficiency and are a poor substitute for a true cut to frequency resonate antenna.

Simply put, the antenna is the weak link in the systems known in the art today. Thus, there is a need in the art for providing an antenna that is reasonably small and lightweight and which works efficiently and continuously from 1.5 MHZ to 30 MHz with very low or no reflected power and that can be adjusted by a user from the transmitter/receiver operating position. It, therefore, is an object of this invention to provide a lightweight, small adjustable antenna apparatus and method that operates efficiently over large frequency ranges and does not require the user to leave the transceiver to change antenna lengths.

SUMMARY OF THE INVENTION

Accordingly, the adjustable antenna apparatus and method of the present invention includes an antenna wire control device for controlling the release and retrieval of antenna wire. Antenna wire is attached to the antenna wire control device and an antenna wire tensioning device is attached to the antenna wire.

According to another aspect of the invention, the antenna wire control device includes a positive control device for preventing release and retrieval of the antenna wire. In another aspect, the positive control device includes a worm and a worm gear. According to another aspect, the antenna wire control device is motorized. In another aspect, the antenna wire is metal antenna wire. According to another aspect, the antenna wire tensioning device is selected from a group comprising: weights, elastic material, coil springs, return pulleys and flat springs. In another aspect, the invention includes a release and retrieval limit device.

According to another aspect, the antenna control device is located above ground level and the antenna wire tensioning device is attached at ground level. In another aspect, the antenna control device is located above ground level and the antenna wire tensioning device is located above ground level. According to a further aspect, a radio transmitter/receiver is connected to the antenna wire.

In accordance with another embodiment of the invention, an adjustable HF antenna apparatus includes a HF antenna wire control device for controlling the release and retrieval of HF antenna wire. At least two HF antenna wires are attached to the HF antenna wire control device and an HF antenna wire tensioning device is attached to the at least two HF antenna wires and to an equal number of non-metallic guide lines.

According to a further aspect of the invention, the HF antenna wire control device includes a positive control device for preventing release and retrieval of the at least two HF antenna wires.

In another aspect, the HF antenna wire tensioning device is selected from a group comprising: weights, elastic material, coil springs, return pulleys and flat springs. In another aspect, the invention includes a release and retrieval limit device.

In accordance with another embodiment of the invention, a method of providing an adjustable HF antenna includes providing a HF antenna wire control device for controlling the release and retrieval of HF antenna wire. Providing two HF antenna wires and attaching one end of the two HF antenna wires to the HF antenna wire control device. Providing a HF antenna wire tensioning device and attaching a second end of the two HF antenna wires to the HF antenna wire tensioning device and operating the HF antenna wire control device so as to release or retrieve a desired amount of the two HF antenna wires while the HF antenna wire tensioning device keeps the two HF antenna wires under tension.

In accordance with another aspect of the invention, a positive control device is provided and connected to the HF antenna wire control device for preventing uncontrolled release and retrieval of the two HF antenna wires. According to another aspect, the step is added of selecting the HF antenna wire tensioning device from a group comprising:

weights, elastic material, coil springs, return pulleys and flat springs. In another aspect, the step is added of connecting a release and retrieval limit device to the HF antenna control device for preventing the release or retrieval of a predetermined amount of HF antenna wire.

According to another aspect, steps are added for locating the HF antenna wire control device a distance above ground level and for securing the HF antenna wire tensioning device below the HF antenna wire control device such that the HF antenna wire is extended in a downward direction from the HF antenna wire control device.

According to another aspect, steps are added for locating the HF antenna wire control device a distance above ground level and for securing the HF antenna wire tensioning device such that the HF antenna wire is extended approximately horizontally from the HF antenna wire control device.

DETAILED DESCRIPTION OF THE INVENTION

Figure 1:
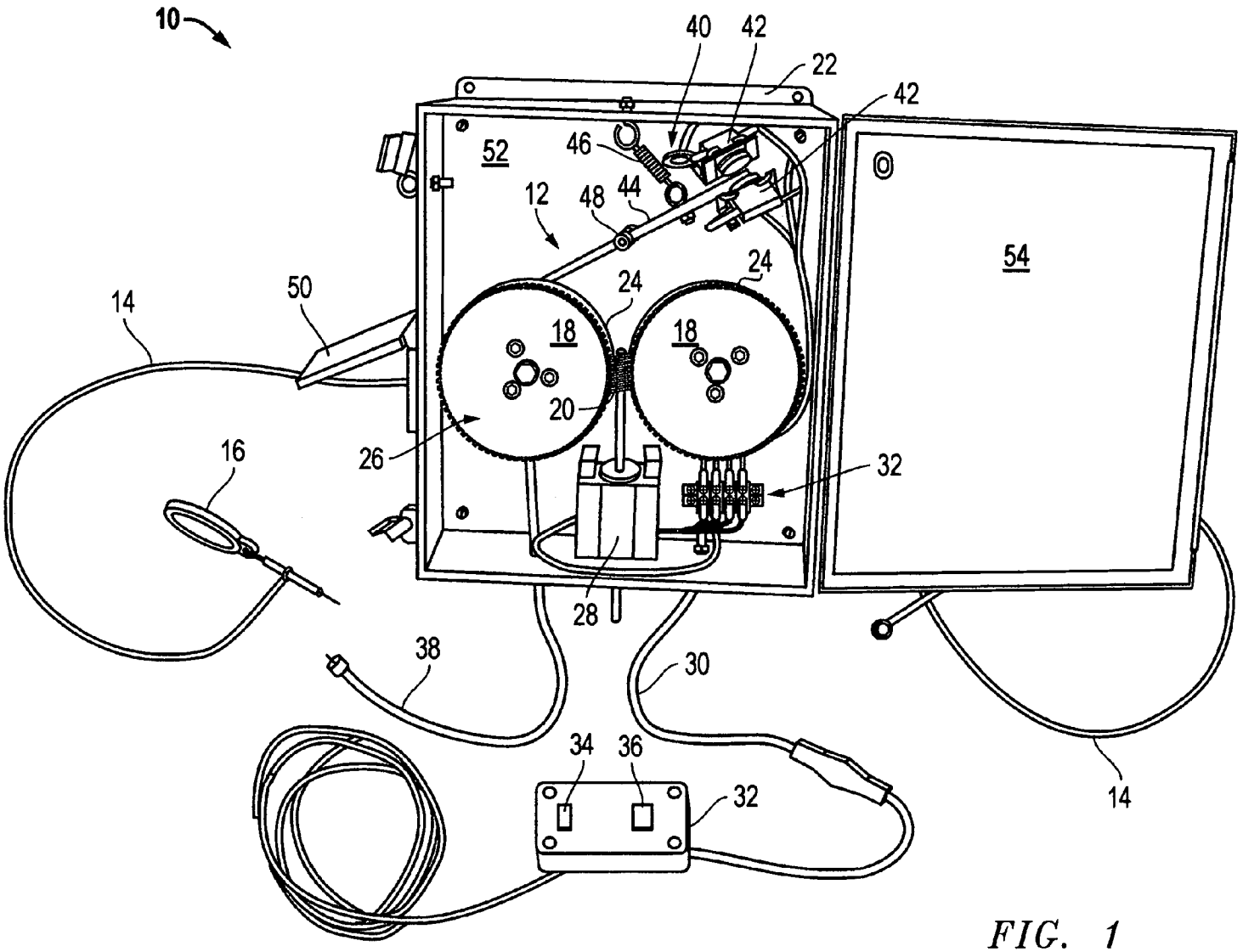
FIG. 1 is a front view of the adjustable antenna apparatus according to an embodiment of the invention shown with an enclosure in the open position.

The preferred embodiment of the present invention is illustrated by way of example in FIGS. 1-4. With specific reference to FIG. 1, the adjustable antenna 10 of the present invention, according to one embodiment, includes antenna wire control device 12. Antenna wire 14 is attached to wire control device 12. Antenna wire tensioning device 16 is attached to antenna wire 14.

According to one embodiment, antenna wire control device 12 includes a pair of worm gears 18 and a worm 20 which operate as is known in the art. Antenna wire 14 in two parts is connected at the one end of the antenna wire located within enclosure 22 to a pair of reels 24. When moved in one direction by worm 20, the antenna wire 14 is wound onto reels 24 and when operated in the opposite direction antenna wire 14 is released from reels 24. In combination worm 20 and worm gears 18 create a positive control device 26 that ensures that no antenna wire 14 is released or retrieved until the worm 20 and the worm gears 18 are moved by the user. That is, no movement is possible if the worm 20 is not moving thus securing the reels 24 in the exact position selected by the user. While positive control device 26 may be hand operated, FIG. 1 shows a motorized adjustable antenna 10 including motor 28, power cord 30 and power connections 32, located within enclosure 22.

Antenna wire tensioning device 16 is attached to the extended free end of antenna wire 14, that is the end of antenna wire 14 not attached to reels 24, as will be more fully discussed hereafter.

Power connections 32 connected to power cable 30 are energized by use of control box 32. Control box 32 includes on/off switch 34 and release/retrieve switch 36. With the power on, a user releases or retrieves antenna wire 14 by the operation of release/retrieve switch 36 as desired and in the comfort of whatever shelter the user has, home, office, or encampment. Obviously, a user will connect the transmitter, receiver or transceiver (not shown) to the antenna wire 14 through cable 38. The signal from the antenna wire 14 is carried on cable 38, such as coax RF cable as is known.

Still referring to FIG. 1, according to one embodiment, adjustable antenna 10 includes a release and retrieval limit device 40. Release and retrieval limit device 40, according to one embodiment, includes limit switches 42, contact lever 44 and limit switch lever spring return 46. As shown in FIG. 1, antenna wire 14 is fully retrieved onto reels 24. Before retrieving too much antenna wire 14, however, release and retrieval limit device 40 is activated thus preventing the retrieval of a predetermined amount of antenna wire 14. In operation, contact lever 44 rides on top of the antenna wire on one of the reels 24. This position is ensured by use of spring return 46 in combination with pivot point 48. As more and more antenna wire is retrieved, contact lever 44 is rotated around pivot point 48 until contact is made with limit switch 42 which operates in a known manner to stop retrieval of antenna wire 14 by any further operation of the control box 32. Likewise, as antenna wire 14 is released, contact lever 44 is kept in position by spring return 46 and rotates about pivot point 48 due to spring return 46 until contact lever 44 is pulled, for example only and not by way of limitation, into contact with opposite limit switch 42 and release of antenna wire 14 is stopped.

The user may set any desired release and retrieval limits found useful. The Applicant has found that a release limit that leaves five feet of antenna wire 14 on reels 24 and a retrieval limit that leaves five feet extended are satisfactory limits for use of the invention across all frequency ranges.

FIG. 1 also shows weather cover 50 that shields the interior 52 of enclosure 22 in use. Likewise, hinged door 54 provides access to the interior 52 of enclosure 22 whenever necessary. Enclosure 22 is a weather proof box made of any suitable material such as metal or plastic. Likewise, it should be understood that antenna wire 14 may be any antenna wire now known or hereafter developed such as stainless steel wire, metal tape or any other form, material or shape for example only and not by way of limitation.

Figure 2:
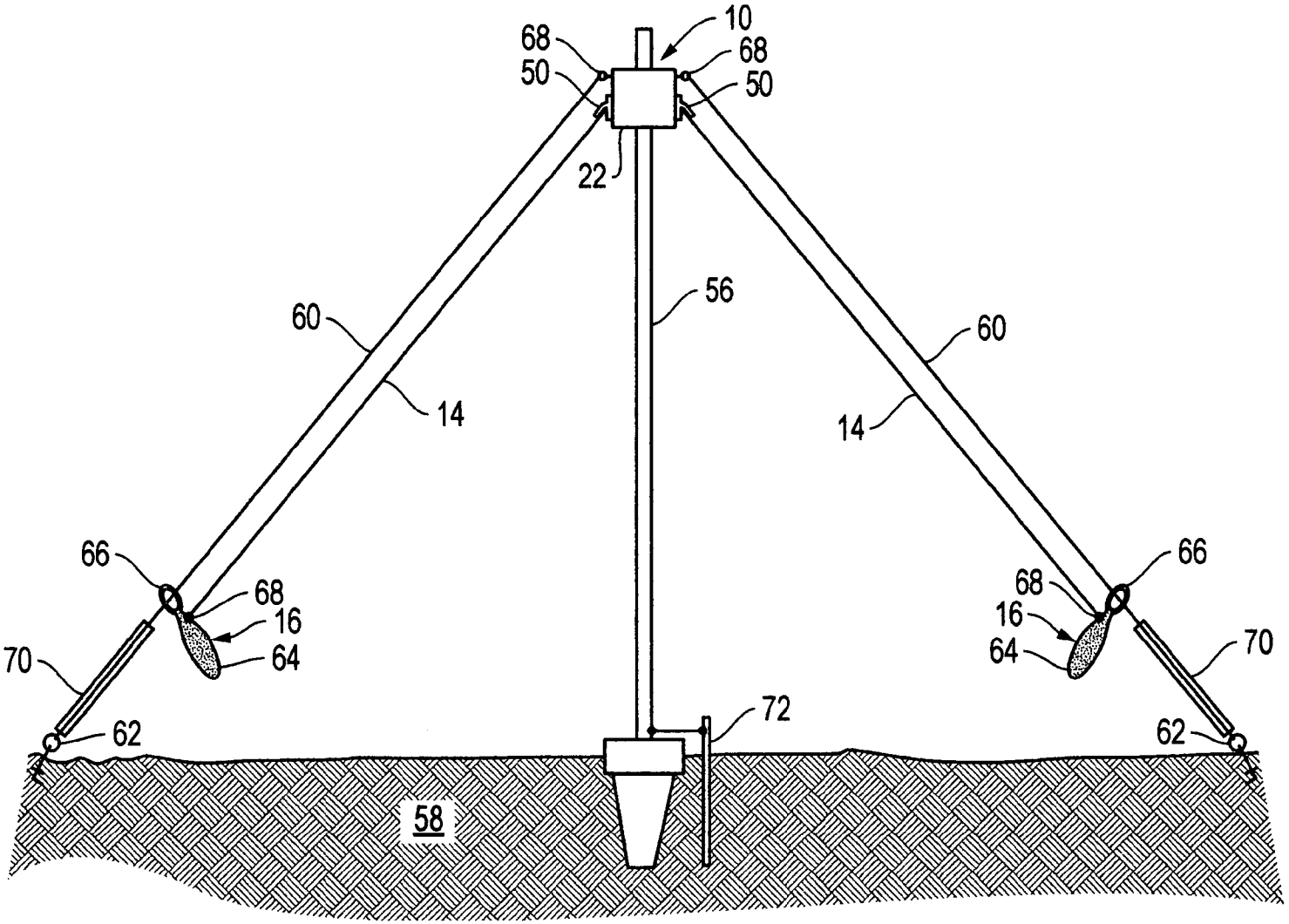
FIG. 2 is a front view of an embodiment of the invention with the antennas fully extended in an inverted V configuration.

Referring now to FIG. 2, a typical configuration for use of the adjustable antenna 10 of the present invention is illustrated showing a one-half wave length dipole HF antenna in the inverted V configuration. Enclosure 22 may include pre-installed attachment hooks or other suitable means for attaching the enclosure 22 in a desired location. In accordance with this embodiment, enclosure 22 is attached to pole 56 in a position elevated above the ground 58. As shown, a pair of non-metallic guide lines 60 are connected at one end to enclosure 22 and at the other end to the ground 58. Guide lines 60 may be connected to eye bolt auger anchors 62 screwed into the ground 58 or by any other means now known or hereafter developed.

According to this embodiment, tensioning device 16 includes a weight 64. Antenna wire 14 is attached to weight 64 and weight 64 is attached to guide line 60, as for example only, by eye bolt 66. Weight 64 may be any type of heavy material useful for the purpose. In operation, weight 64 applies constant even tension to antenna wire 14 while riding up and down on guide line 60 as the user retrieves and releases antenna wire 14 as desired to achieve the best and most useful frequency.

Any type of connectors may be used to connect antenna wire 14 to weight 64 and guide lines 60 to enclosure 22 as are now known or hereafter developed. Further, bright colored plastic safety shields 70 may be attached to guide lines 60 near the ground 58. As illustrated, the length of the guide lines 60 are approximately one hundred and fifty-six feet with approximately twelve additional feet protected by safety shields 70. This enables a user to release a sufficient amount of antenna wire to cover even the lowest used frequency.

FIG. 2 also shows that pole 56 includes an attached ground rod 72 and support 74 in ground 58. Support 74 may be any useful pole support such as concrete. Power cord 30, control box 32 and cable 38 are not shown in the figures, other than FIG. 1, in order to better illustrate the pertinent embodiments without confusion.

Figure 3:
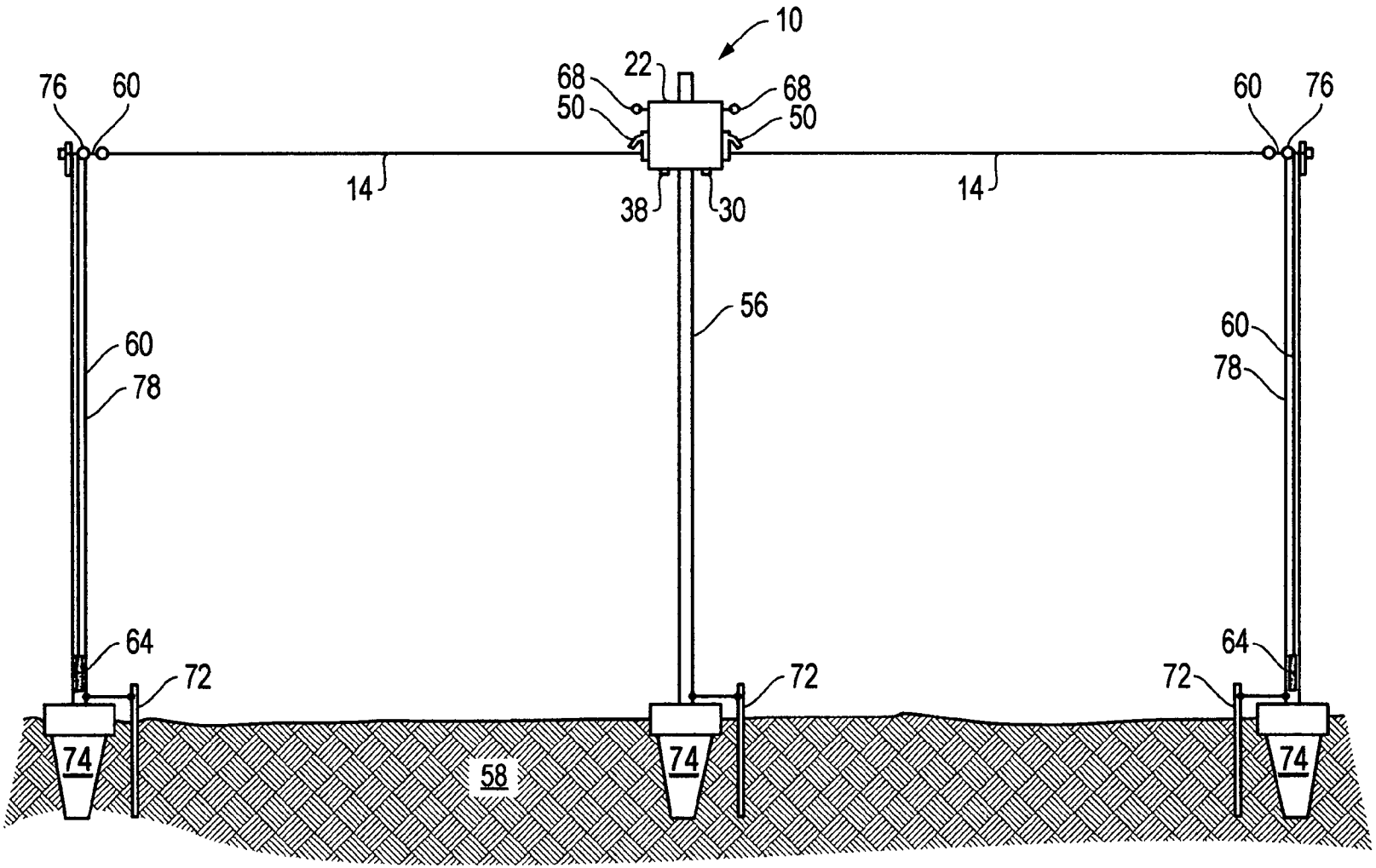
FIG. 3 is front view of an embodiment of the invention with the antennas fully extended in a horizontal configuration.

Referring now to FIG. 3, another embodiment of the adjustable antenna 10 of the present invention is illustrated showing a one-half wave length dipole HF antenna in the horizontal configuration. That is, according to this embodiment, antenna wire 14 is extended approximately horizontally from enclosure 22. Here, weight 64 is attached directly to guide line 60 and guide line 60 is attached to antenna wire 14. Guide line 60 passes over a pulley 76 attached at the top of a guide tube 78. Weight 64 rides up and down inside guide tube 78 applying constant even tension to antenna wire 14 as described above. In combination, however, guide tube 78 and pulley 76 create a tensioning device 16 that causes antenna wire 14 to be released and retrieved approximately horizontally as illustrated. Guide tubes 78 include support 74 and ground rods 72 as described above.

Figure 4:
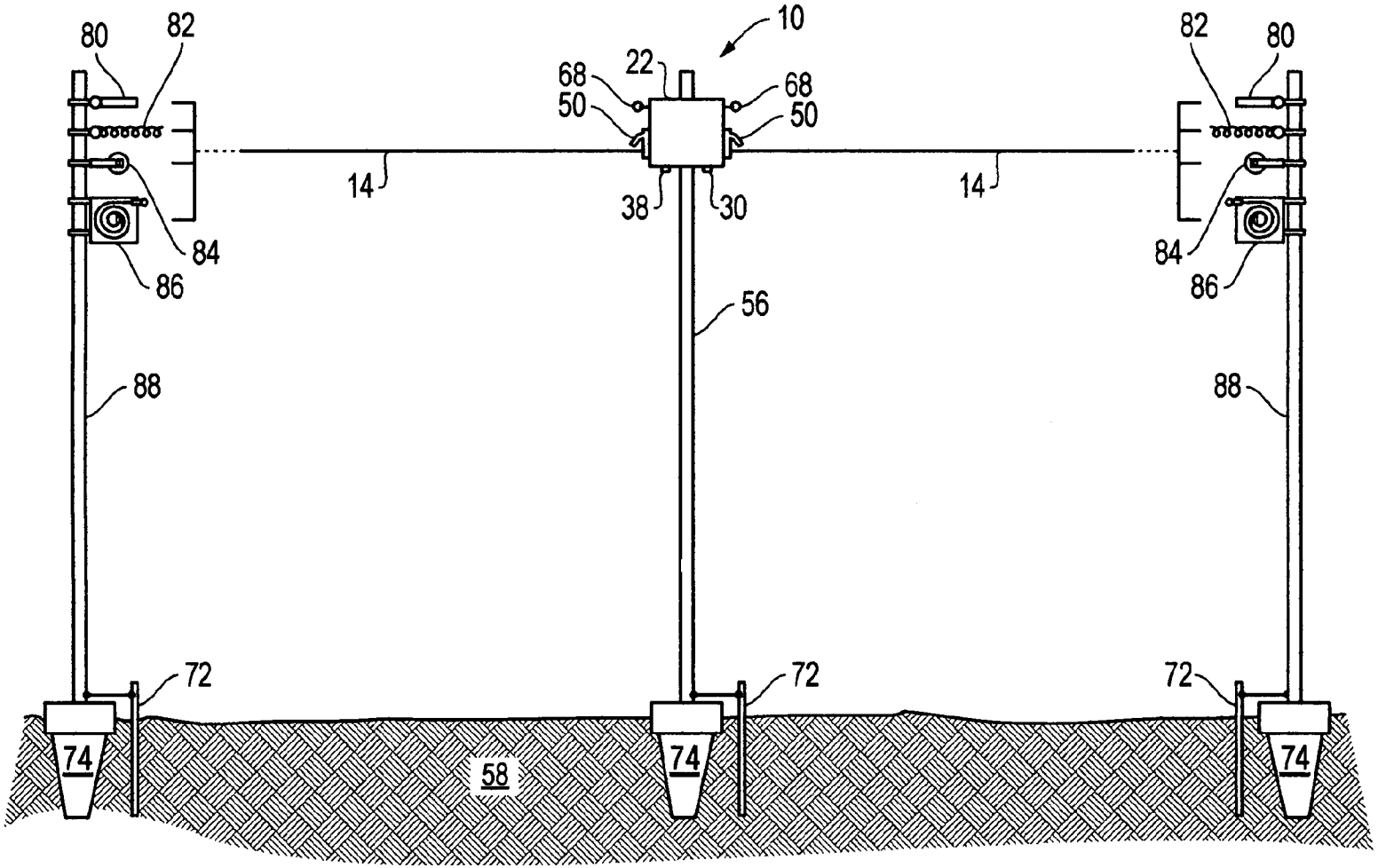
FIG. 4 is a front view of an embodiment of the invention with the antennas fully extended in a horizontal configuration illustrating a variety of alternate tensioning devices.

Referring now to FIG. 4, multiple additional embodiments of tensioning devices 16 are illustrated. According to this figure, antenna wire 14 is extended horizontally as discussed above but, obviously, these embodiments may be used with the inverted V configuration shown in FIG. 2 as well. As per FIG. 4, antenna wire 14 may be tensioned by connecting it to an elastic material 80, a coil spring 82, return pulley 84 or flat spring 86. In these embodiments, elastic material 80, coil spring 82, return pulley 84 and flat spring 86 are connected on the other end to support pole 88 at a distance sufficient to allow enough antenna wire 14 to be released so as to cover the widest range of frequencies desired. Elastic material 80 may be any elastic material now known or hereafter developed such as elastic rubber tubing for example. Coil spring 82 is selected from any known coil springs. Likewise, flat spring 88 is selected from any known flat springs determined suitable for the purposes of the invention. Return pulley 84 is a pulley around which the guide line 60 is passed. In this embodiment, the guide line returns to the enclosure 22 where it is wound around another set of reels 24 which operate as indicated above so as to be moved in conjunction with the antenna wire reels 24. According to these embodiments, the tensioning device 16 does not include a moveable weight 64 or the like. Other elements of the invention function as described above.

The description of the present embodiments of the invention have been presented for purposes of illustration but are not intended to be exhaustive or to limit the invention to the form disclosed. Many modifications and variations will be apparent to those of ordinary skill in the art. As such, while the present invention has been disclosed in connection with the preferred embodiment thereof, is should be understood that there may be other embodiments which fall within the spirit and scope of the invention as defined by the following claims.

What is claimed is:

1. An adjustable antenna apparatus comprising:

a) an antenna wire control device for controlling the release and retrieval of antenna wire wherein the antenna wire control device includes a positive control device for preventing release and retrieval of said antenna wire;

b) antenna wire attached to said antenna wire control device; and c) an antenna wire tensioning device attached to said antenna wire.

2. The apparatus of claim 1 wherein said antenna wire control device is motorized.

3. The apparatus of claim 1 wherein said antenna wire control device is metal antenna wire.

4. The apparatus of claim 1 wherein said antenna wire tensioning device is selected from a group comprising: weights, elastic material, coil springs, return pulleys and flat springs.

5. The apparatus of claim 1 further including a release and retrieval limit device.

6. The apparatus of claim 1 wherein said antenna control device is located above ground level and said antenna wire tensioning device is attached at ground level.

7. The apparatus of claim 1 wherein said antenna control device is located above ground level and said antenna wire tensioning device is located above ground level.

8. The apparatus of claim 1 further comprising a radio transmitter/receiver connected to the antenna wire.

9. An adjustable HF antenna apparatus comprising:

a) a HF antenna wire control device for controlling the release and retrieval of HF antenna wire wherein the HF antenna wire control device includes a positive control device for preventing release and retrieval of said at least two HF antenna wires;

b) at least two HF antenna wires attached to said HF antenna wire control device; and c) an HF antenna wire tensioning device attached to said at least two HF antenna wires and to an equal number of non-metallic guide lines.

10. The apparatus of claim 9 wherein said HF antenna wire tensioning device is selected from a group comprising: weights, elastic material, coil springs, return pulleys and flat springs.

11. The apparatus of claim 9 further including a release and retrieval limit device.

12. A method of providing an adjustable HF antenna comprising:

a) providing a HF antenna wire control device for controlling the release and retrieval of HF antenna wire;

b) providing two HF antenna wires and attaching one end of the HF antenna wires to said HF antenna wire control device;

c) providing a HF antenna wire tensioning device and attaching a second end of the two HF antenna wires to said HF antenna wire tensioning device; and d) operating the HF antenna wire control device so as to release or retrieve a desired amount of the two HF antenna wires while said HF antenna wire tensioning device keeps the two HF antenna wires under tension.

13. The method of claim 12 further comprising providing a positive control device and connecting it to the HF antenna wire control device for preventing uncontrolled release and retrieval of said two HF antenna wires.

14. The method of claim 12 further comprising selecting the HF antenna wire tensioning device from a group comprising: weights, elastic material, coil springs, return pulleys and flat springs.

15. The method of claim 12 further including connecting a release and retrieval limit device to the HF antenna control device for preventing the release or retrieval of a predetermined amount of HF antenna wire.

16. The method of claim 12 further comprising:

a) locating the HF antenna wire control device a distance above ground level; and b) securing the HF antenna wire tensioning device below said HF antenna wire control device such that said HF antenna wire is extended in a downward direction from said HF antenna wire control device.

17. The method of claim 12 further comprising:

a) locating the HF antenna wire control device a distance above ground level; and b) securing the HF antenna wire tensioning device such that said HF antenna wire is extended approximately horizontally from said HF antenna wire control device.

18. An adjustable antenna apparatus comprising:

a) an antenna wire control device for controlling the release and retrieval of antenna wire wherein the antenna wire control device includes a positive control device for preventing release and retrieval of said antenna wire and wherein said positive control device includes a worm and a worm gear;

b) antenna wire attached to said antenna wire control device; and c) an antenna wire tensioning device attached to said antenna wire.

* * * * *